US005700746A

United States Patent [19]

Kutami et al.

[11] Patent Number: 5,700,746

[45] Date of Patent: Dec. 23, 1997

[54] REVERSIBLE THERMOSENSITIVE RECORDING MEDIUM

[75] Inventors: Atsushi Kutami; Eiichi Kawamura, both of Numazu; Keishi Kubo, Yokohama, all of Japan

[73] Assignee: Ricoh Company, Ltd., Tokyo, Japan

[21] Appl. No.: 611,182

[22] Filed: Mar. 5, 1996

[30] Foreign Application Priority Data

Mar. 6, 1995 [JP] Japan ..... 7-02272
May 15, 1995 [JP] Japan ..... 7-139914

[51] Int. Cl.[6] ..... B41M 5/26; B41M 5/40

[52] U.S. Cl. ..... 501/201; 503/206; 503/226

[58] Field of Search ..... 427/152; 503/201, 503/206, 226

[56] References Cited

U.S. PATENT DOCUMENTS 5,278,128 1/1994 Hotta et al. ..... 503/207
5,283,220 2/1994 Kawaguchi et al. ..... 503/200
5,310,718 5/1994 Amano et al. ..... 503/201
5,448,065 9/1995 Masubuchi et al. ..... 250/316.1

FOREIGN PATENT DOCUMENTS 0 535 930 4/1993 European Pat. Off. .
5 38873 2/1993 Japan .
5 139080 6/1993 Japan .

*Primary Examiner*—Bruce H. Hess
*Attorney, Agent, or Firm*—Oblon, Spivak, McClelland, Maier & Neustadt, P.C.

[57] ABSTRACT

A reversible thermosensitive recording medium is disclosed which includes an opaque support and a transparent recording film having a thermosensitive layer capable of reversibly assuming a maximum transparent state and a maximum opaque state depending upon the thermal hysteresis thereof. The recording film has an image display section in which a void space is provided between the recording film and the opaque support and a color discriminative from the color of the support. The display section in the maximum transparent state shows a reflectance greater by 5% than that in the maximum opaque state and a transmittance of 20–80% in the maximum transparent state, so that the visibility of the recorded image is improved.

13 Claims, 3 Drawing Sheets

REVERSIBLE THERMOSENSITIVE RECORDING MEDIUM

BACKGROUND OF THE INVENTION

This invention relates to a reversible thermosensitive recording medium which permits repeated formation and erasure of images by utilizing a reversible change in transparency of a thermosensitive layer thereof according to a temperature change.

One well known reversible thermosensitive recording medium has a construction in which a thermosensitive layer containing particles of an organic low molecular weight material, such as a higher fatty acid, dispersed in a matrix resin is laminated on an opaque support. The thermosensitive layer is capable of reversibly assuming at 25° C. a maximum transparent state and a maximum white opaque state depending upon the thermal hysteresis thereof. Namely, when such a medium is heated at a first temperature (e.g. 90° C.), the thermosensitive layer becomes transparent. When the medium is then cooled to room temperature (25° C.), the thermosensitive layer remains transparent. However, when the medium is heated at a higher, second temperature (e.g. 120° C.) and when the medium is thereafter cooled to room temperature, the layer turns milky white. Thus, by heating the recording medium imagewise with a thermal head at the second temperature, a white opaque image can be obtained upon being cooled to room temperature. The image is erased when heated at the first temperature.

Known reversible thermosensitive recording media have a problem because the contrast between the background and the image is low. To cope with this problem, JP-A-64-14079 proposes to provide an aluminum foil on the reverse side of the support. Whilst the contrast is increased by the provision of the aluminum foil, the image fails to clearly see when viewed obliquely due to light reflection on the aluminum foil.

U.S. Pat. No. 5,278,128 discloses a reversible thermosensitive recording medium including a support, an undercoat layer on the support, and a thermosensitive layer on the undercoat layer, wherein the undercoat layer has colored portions and light reflecting portions arranged to form a pattern. While the visual recognition of images may be facilitated by this technique, it is troublesome to form the pattern of the light reflecting and colored portions in the undercoat layer.

JP-A-5-124382 discloses a reversible thermosensitive recording medium including a support having a colored surface and a transparent recording film having a thermosensitive layer and provided over the colored surface of the support such that a void space (air layer) is defined therebetween. While the provision of the air layer is effective to some extent in overcoming the problem caused by the use of the aluminum foil, the visibility or legibility of the image is not fully satisfactory.

SUMMARY OF THE INVENTION

It is, therefore, the prime object of the present invention to provide a reversible thermosensitive recording medium which can give an easily and clearly legible image.

In accomplishing the above object, there is provided in accordance with the present invention a reversible thermosensitive recording medium including an opaque support, and a transparent recording film provided over a surface of the opaque support and including at least one transparent layer, one of the at least one transparent layer being a thermosensitive layer capable of reversibly assuming a maximum transparent state and a maximum opaque state depending upon the thermal hysteresis thereof. The transparent recording film has an image display section in which a void space is provided between the transparent recording film and the opaque support. One of the at least one transparent layer in the display section contains a colorant having a first color and $\lambda_{max}$ providing a maximum absorbance in the visible region. The opaque support in the area corresponding to the display section has a second color discriminative from the first color. The reflectance, in terms of %, of the display section for light with the wavelength of $\lambda_{max}$ is $R_x$ when the thermosensitive layer assumes at the maximum transparent state but is $R_y$ when the thermosensitive layer assumes the maximum opaque state, the reflectance $R_x$ being greater by at least 5% than the reflectance $R_y$. The transmittance of the display section of the transparent recording film for light with the wavelength of $\lambda_{max}$ is 20–80%, when the thermosensitive layer assumes the maximum transparent state.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

The reversible thermosensitive recording medium according to the present invention includes an opaque support and a transparent recording film provided over a surface of the support and one or more transparent layers, one of which transparent layers is a thermosensitive layer.

The thermosensitive layer used in the present invention is composed of an organic low molecular weight substance uniformly dispersed in a resin matrix abd is capable of reversibly assuming at 25° C. a maximum transparent state and a maximum white opaque state depending upon the thermal hysteresis thereof.

Although not wishing to be bound by the theory, the mechanism of the change of the reversible thermosensitive layer between white opaqueness and transparency according to the present invention is considered to be as follows.

In the transparent state, the particles of the organic low molecular weight material dispersed in the resin matrix is in close contact with the resin matrix without any space therebetween and without any space within the particles, so that incident light can be transmitted therethrough without being scattered. In the white opaque state, there are formed interstices at the interface between the fine crystals of the organic low molecular weight material particles and at the interface between the particles and the matrix resin, so that incident light is reflected on the interfaces and, thus, scattered.

Figure 6:
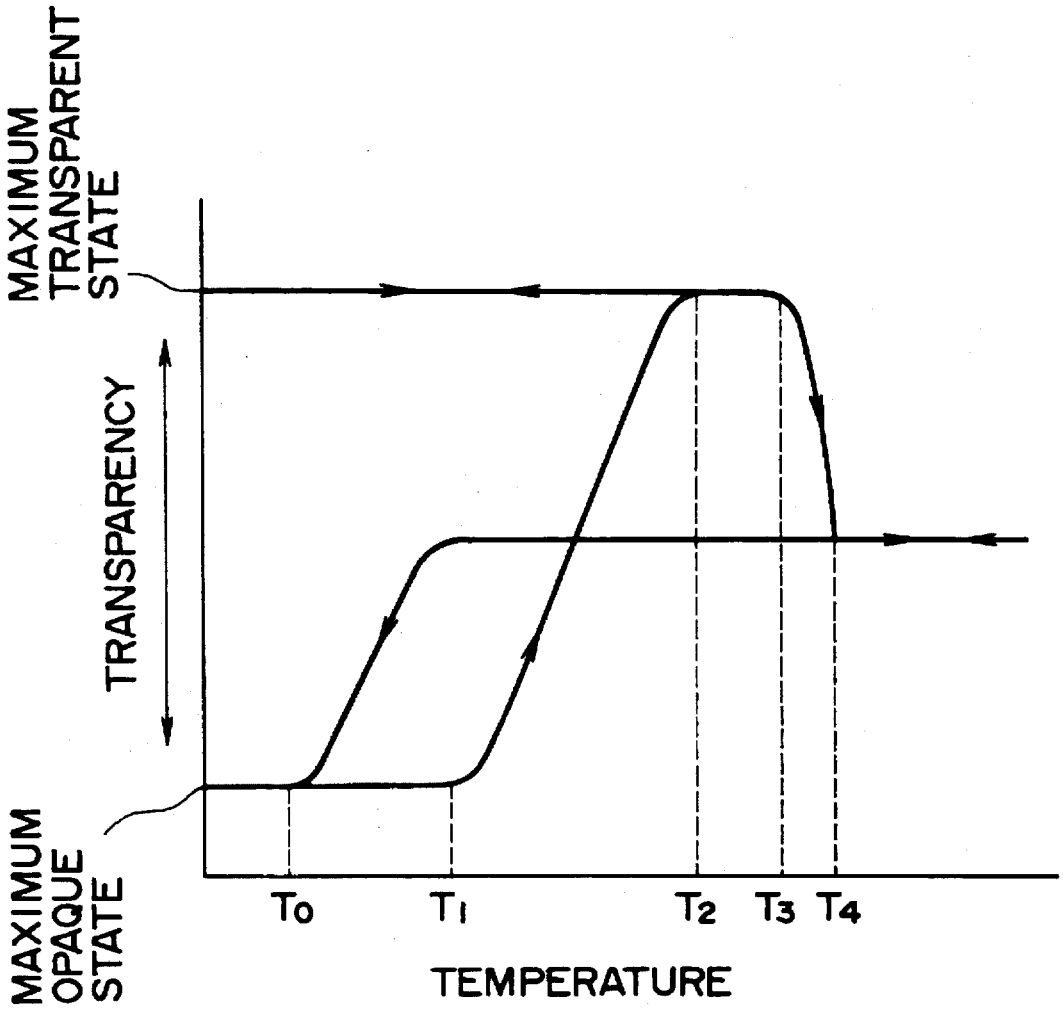
FIG. 6 shows temperature dependency of the transparency of a thermosensitive layer.

Now, referring to FIG. 6, the thermosensitive layer is in a maximum white opaque state at an ambient temperature of $T_0$ or below. Upon being heated, the thermosensitive layer begins becoming gradually transparent at a temperature $T_1$ and becomes completely transparent at $T_2$–$T_3$. When cooled to ambient temperature below $T_0$ as such, the layer remains transparent. Namely, as the temperature is increased to $T_1$, the resin begins softening. As the softening proceeds, the resin fills the space between the resin and the particles of the organic low molecular weight material and between the adjacent particles, so that the transparency increases. At a temperature of $T_2$–$T_3$, the organic low molecular weight material partly melts so that the remaining space is filled therewith, whereby the layer becomes transparent. When the layer is cooled as such, the organic low molecular weight material is crystallized at a relatively high temperature because of the presence of seed crystals. In this case, since the resin still remains in a softened state, the resin can follow the volume changes caused by the crystallization of the organic low molecular weight material, so that no space is formed, i.e. the layer assumes the maximum transparent state upon being cooled.

On the other hand, when heated to a temperature $T_4$ or more, the layer becomes translucent. When the temperature is then lowered, the layer returns to the original maximum white opaque state rather than the transparent state. This phenomenon may be explained as follows. At a temperature of $T_4$ or more, the low molecular weight material is completely melted. When the temperature is then lowered, the low molecular weight material is crystallized at a temperature lower than $T_1$ under a supercooled state. In this case, the resin which is no longer in the softened state cannot follow the volume change of the low molecular weight material caused by the crystallization thereof, so that there is formed space. The temperature-transparency curve shown in FIG. 6 represents a typical example and the transparency will vary when the materials used are changed.

The matrix resin may be, for example, poly(vinyl chloride); vinyl chloride copolymers such as vinyl chloride-vinyl acetate copolymers, vinyl chloride-vinyl acetate-vinyl alcohol copolymers, vinyl chloride-vinyl acetate-maleic acid copolymers and vinyl chloride-acrylate copolymers; poly(vinylidene) chloride; vinylidene chloride copolymers such as vinylidene chloride-vinyl chloride copolymers and vinylidene chloride-acrylonitrile copolymers; polyesters; polyamides; polyacrylate, polymethacrylate or acrylate-methacrylate copolymers; silicone resins; polyethylene; polypropylene; polystyrene; styrene-butadiene copolymers; polyacrylamide; polyvinylpyrrolidone; natural rubber; polyvinyl alcohol; polyacrolein; and polyacarbonate. These resins may be used singly or in combination of two or more.

The organic low molecular weight material is in the form of particles in the thermosensitive layer. Generally used is a material having a melting point of 30°–200° C., preferably 50°–150° C. Examples of the organic low molecular weight materials include alkanols; alkanediols; halogenated alkanols; halogenated alkane diols; alkylamines; alkanes; alkenes; halogenated alkanes; halogenated alkenes; halogenated alkynes; cycloalkanes; cycloalkenes; cycloalkynes; saturated or unsaturated mono or dicarboxylic acids or esters, amides or ammonium salts thereof; saturated or unsaturated halogenated fatty acids or esters, amides and ammonium salts thereof; allylcarboxylic acid or esters, amides or ammonium salts thereof; halogenated allylcarboxylic acid or esters, amides or ammonium salts thereof; thiols; thiocarboxylic acids or esters, amines or ammonium salts thereof; and carboxylic acid esters of thiols. These compounds may be used by themselves or as a mixtures of two or more. These compounds have 10–60 carbon atoms, preferably 10–38 carbon atoms, more preferably 10–30 carbon atoms. The alcohol group of the ester may be saturated or unsaturated or may be substituted with a halogen. It is preferred that the low molecular weight material have at least one of oxygen, nitrogen, sulfur and halogen in its molecule, such as —OH, —COOH, —CONH—, —COOR, —NH—, —$NH_2$, —S—, —S—S—, —O— or halogen.

One preferred combination of the matrix resin with the organic low molecular weight substance is a combination of a styrene-butadiene copolymer resin matrix with a saturated carboxylic acid having 10–24 carbon atoms, such as capric acid, lauric acid, dodecanoic acid, myristic acid, pentadecanoic acid, palmitic acid, stearic acid, behenic acid, nonadecanoic acid, lignoceric acid, arachic acid, icosanedioic acid and oleic acid.

The weight ratio of the organic low molecular weight material to the matrix resin in the thermosensitive layer is preferably 2:1 to 1:20, more preferably 1:2 to 1:8. It is preferred that the recording layer have a thickness of 1–30 μm, more preferably 2–20 μm.

The thermosensitive layer may contain, in addition to the above ingredients, additives such as a surfactant and a plasticizer to facilitate the formation of transparent images. As the plasticizer, there may be mentioned phosphoric acid esters, fatty acid esters, phthalic acid esters, dibasic acid esters, glycols, polyester plasticizers and epoxy plasticizers. Specific examples of the plasticizers include tributyl phosphate, tri-2-ethylhexyl phosphate, triphenyl phosphate, ticresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethyleneglycol dibenzoate, triethyleneglycol di-2-ethylbutylate, methyl acetylricinoleate, butyl acetylricinoleate, butyl phtharylbutylglycolate and tributyl acetylcitrate.

Examples of surfactants and other additives include higher fatty acid esters of a polyhydric alcohol; higher alkyl ethers of a polyhydric alcohol; lower olefin oxide adducts of a polyhydric alcohol higher fatty acid ester, a higher alcohol, a higher alkylphenol, a higher fatty acid higher alkylamine, a higher fatty acid amide, a fat or a polypropylene glycol; acetylene glycol; Na, Ca, Ba or Mg salts of a higher alkylbenzenesulfonic acid; Ca, Ba or Mg salts of an aromatic carboxylic acid, a higher fatty acid sulfonic acid, aromatic sulfonic acid, sulfuric acid monoester or mono or diester of phosphoric acid; low degree sulfonated oil; poly(long chain alkyl acrylate); acrylic oligomers; poly(long chain alkyl methacrylate); copolymers of long chain alkylmethacrylate with amine-containing monomer; styrene-maleic anhydride copolymers; and olefin-maleic anhydride copolymers.

A transparent surface protective layer (thickness: 0.1–10 μm) may be formed on the thermosensitive layer for protecting same. As the material for the protective layer, a silicone rubber, a silicone resin (disclosed in JP-A-63-221087), a polysiloxane graft polymer (JP-A-63-317385), an ultraviolet radiation-curable resin or an electron beam-curable resin (JP-A-2-566) may be employed. In any case, a solvent is used for coating the protective layer. It is desired that the solvent used be such that the matrix resin and the organic low molecular weight material of the thermosensitive layer are hardly soluble therein. Examples of the solvents include n-hexane, methanol, ethanol and isopropanol. In particular, the use of an alcohol-series solvent is desirable from the standpoint of the costs.

Further, a transparent intermediate layer may be interposed between the protective layer and the thermosensitive layer to protect the thermosensitive layer from the solvent or a monomer component of the protective layer formation liquid (as disclosed in JP-A-1-133781). In addition to the resins exemplified as the resin matrix material for the thermosensitive layer, the following thermosetting resins and thermoplastic resins may be used as the material for the intermediate layer: polyethylene, polypropylene, polystyrene, polyvinyl alcohol, polyvinyl butyral, polyurethane, saturated polyester, unsaturated polyester, epoxy resin, phenolic resin, polycarbonate and polyamide. The intermediate layer preferably has a thickness of 0.1–2 μm.

If desired, a transparent adhesive layer may be interposed between the thermosensitive layer and the support. Illustrative of suitable adhesive agents are polyester resins, poly (vinyl alcohol) resins, poly(vinyl chloride) resins, epoxy resins and poly(vinyl butyral) resins. The thickness of the adhesive layer is generally 0.1–100 μm.

Further, a transparent, inorganic material-containing layer having an index of refraction different from that of the thermosensitive layer may be suitably incorporated into the transparent recording film such as between the thermosensitive layer and the support. The inorganic material may be, for example, ZnS, $SiO_2$, $Sb_2S_3$, $Fe_2O_3$, PbO, ZnSe, CdS, $Bi_2O_3$, $TiO_2$, $PbCl_2$, $CeO_2$, $Ta_2O_3$, ZnO, CdO, $Nd_2O_3$, $Sb_2O_3$, $ZrO_2$, $WO_3$, $Pr_3O_7$, SiO, $In_2O$, $Y_2O_3$, TiO, $ThO_2$, $Si_2O_3$, $PbF_2$, $Cd_2O_3$ or $La_2O_3$. Such an inorganic layer may be formed, for example, by vacuum deposition and serves to improve image contrast. The thickness of the inorganic layer is generally 400–4,000 Å.

It is important that at least one of the transparent layers of the transparent recording film provided on the opaque support should have a first color such as red, yellow, blue, dark blue, purple, black, brown, gray, orange, green or black. An organic or inorganic dye or pigment such as a combination of a leuco dye with a developer; a disperse dye such as an azo disperse dye, an anthraquinone disperse dye, quinophthalon disperse dye, nitrodiphenylamine disperse dye or styryl disperse dye; a water-soluble dye such as a direct dye, acid dye or basic dye; or an oil-soluble dye such as monoazo oil dye, bisazo oil-soluble dye, phthalocyanine oil-soluble dye, a monoazo metal complex oil-soluble dye or triallylmethane oil-soluble dye. The colorant may be incorporated into any desired transparent layers on the support, such as the thermosensitive layer, the protecting layer and/or the intermediate layer. The colorant has a maximum absorbance at a wavelength $\lambda_{max}$ in a visible light region.

The use of an oil-soluble dye is preferred since the resulting transparent recording film shows a high light transmittance and yet a high color concentration. The oil-soluble dye is generally used in an amount of 0.01–1 mg, preferably 0.1–0.5 mg, per 100 $cm^2$ of the transparent recording film.

A metal salt (e.g. Cu, Cr, Mn, Ni or Co salt) of an aliphatic carboxylic acid may also be suitably used as a colorant for the thermosensitive layer.

It is also important that the transparent recording film should be formed on the opaque support such that a void space (air layer) is defined therebetween. Since the index of refraction of the thermosensitive layer is quite different from that of air, light is reflected on the interface between the air layer and the transparent recording film to amplify the opaqueness of the recording layer in the clouded state, so that the visibility is improved. Therefore, that portion of the thermosensitive recording medium in which the void space is formed is used as an image displaying section. The thickness of the air layer is generally 0.01–500 μm, preferably 0.1–100 μm, more preferably 1–20 μm. The air layer may be formed by, for example, using suitable spacers or by forming protrusions on the support.

The opaque support may be a film or sheet of a resin, paper, synthetic paper, metal or glass. The film or sheet itself may be opaque. Alternatively, a transparent film or sheet may be laminated with an opaque layer on one of the opposite sides thereof to provide the opaqueness. The support preferably has a reflectance of preferably at least 30%, more preferably at least 60%, for white light with an incident angle of 90°. It is also preferred that the support show a scattering color base of not greater than 1.0 when measured with Macbeth densitometer RD914.

It is important that the opaque support should have a color, such as white, red, yellow, blue, dark blue, purple, black, brown, gray, orange, green or black, different from that of the transparent recording film. A white opaque support having a mirror surface is preferably used.

The reversible thermosensitive recording medium according to the present invention may be prepared as follows. A solvent solution in which the matrix resin matrix and the organic low molecular weight material have been dissolved or a dispersion containing the organic low molecular weight material in the form of fine particles has been dispersed in a solvent solution of the resin matrix is applied onto a transparent film and then dried to form a thermosensitive layer thereon. A protecting layer, an inorganic material-containing layer, etc. may be further provided in a suitable position, as described previously. A colorant is incorporated into at least one of the above layers. The resulting transparent recording film is then bonded with an adhesive or by fusion (heat sealing) to the opaque support with a void space being formed therebetween. The solvent may be, for example, tetrahydrofuran, methyl ethyl ketone, methyl isobutyl ketone, chloroform, carbon tetrachloride, ethanol, toluene or benzene. It is recommendable to adjust the adhesion between the recording film and the opaque support so that the adhesion strength therebetween is at least 0.5 kgf/25 mm when measured by 180° peel test method according to JIS K-6854, as proposed in JP-A-5-169808), for reasons of prevention of curling of the thermosensitive recording medium.

Alternatively, the thermosensitive layer in the form of a film may be prepared by molding such as extrusion. The resulting film is then bonded to the opaque support in the same manner as above. A protecting layer, an inorganic material-containing layer, etc. may be formed on the film, as desired.

If desired, the opaque support may be provided with a magnetic layer, an IC layer, a bar code layer, a cushioning layer or any other desired auxiliary layer.

It is essential that the reflectance ($R_x$), in terms of %, of the display section in the maximum opaque state should be greater by at least 5%, preferably at least 10%, than that ($R_y$) of the display section in the maximum opaque state, in order to obtain excellent image visibility. In other words, the difference ($R_x$–$R_y$) should be at least 5%, preferably at least 10% in order to obtain an easily legible, high contrast image. The light reflectance herein is a value measured at 25° C. using incident light with the wavelength $\lambda_{max}$ providing the maximum absorbance of the colorant contained in the transparent recording film at 90° (perpendicular to the surface of the thermosensitive recording medium) of an angle of incident. The term "maximum transparent state" used herein is intended to refer to the transparency of the display section at 25° C. which has been heated at such a temperature as to provide the maximum transparency at 25° C. The term "maximum opaque state" used herein is intended to refer to the opaqueness of the display section at 25° C. which has been heated at such a temperature as to provide the maximum opaqueness at 25° C.

The difference ($R_x$–$R_y$) increases with an increase of the color concentration of the transparent recording film. However, when the color concentration is excessively increased, the transparency of the recording film becomes poor so that the difference ($R_x$–$R_y$) is decreased.

The transmittance of the display section of the tranparent recording film in the maximum transparent state should be 20–80%, preferably 40–60%, for light with a wavelength of $\lambda_{max}$ providing the maximum absorbance of the colorant contained in the transparent recording film at 90° (perpendicular to the surface of the thermosensitive recording medium) of an angle of incident, in order to obtain the required difference ($R_x$–$R_y$).

The preferred embodiments of the present invention will further be described with reference to the drawings. The same reference numerals designate similar constituents.

Figure 2:
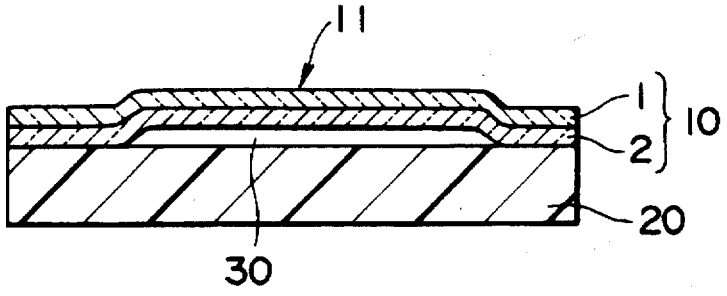
FIG. 2 is a cross-sectional view taken along the line II—II in FIG. 1 and showing an image display section.

Referring to FIG. 2, designated as 10 is a transparent recording film provided on an opaque support 20 with a space 30 being defined therebetween at an image display section 11. The recording film 10 is composed of a transparent film layer 2 and a thermosensitive layer 1 provided on the transparent film layer 2. One of the layers 1 and 2 contains a colorant.

Figure 3:
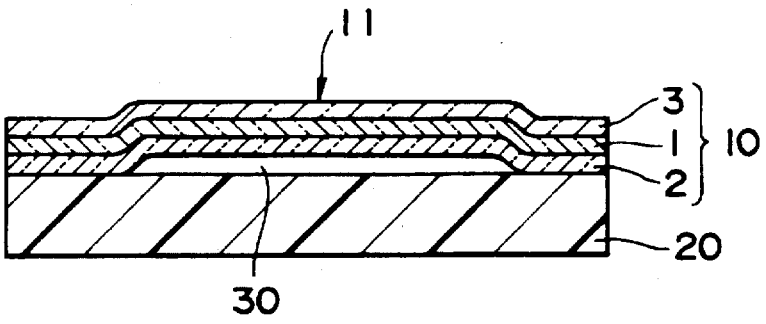
FIG. 3 is a sectional view, similar to FIG. 2, showing another embodiment of the present invention.

In the embodiment shown in FIG. 3, the thermosensitive layer 1 of FIG. 2 is overlaid with a protecting layer 3. One of the layers 1–3 contains a colorant.

Figure 4:
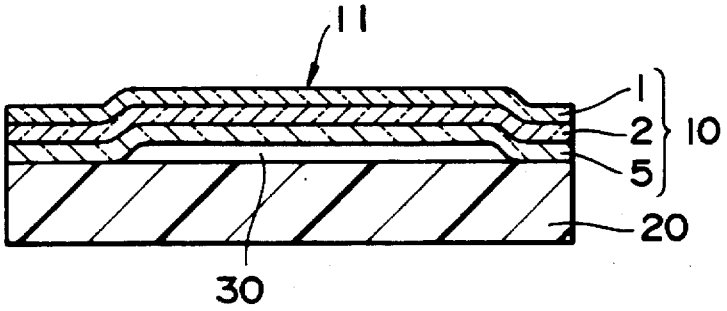
FIG. 4 is a sectional view, similar to FIG. 2, showing a further embodiment of the present invention.

In the embodiment shown in FIG. 4, the transparent film layer 2 of FIG. 2 is coated with a transparent, inorganic material-containing layer 5. The inorganic layer 5 may be positioned between the transparent film layer 2 and the thermosensitive layer 1. The thermosensitive layer 1 may be overlaid with a protecting layer, if desired.

Figure 1:
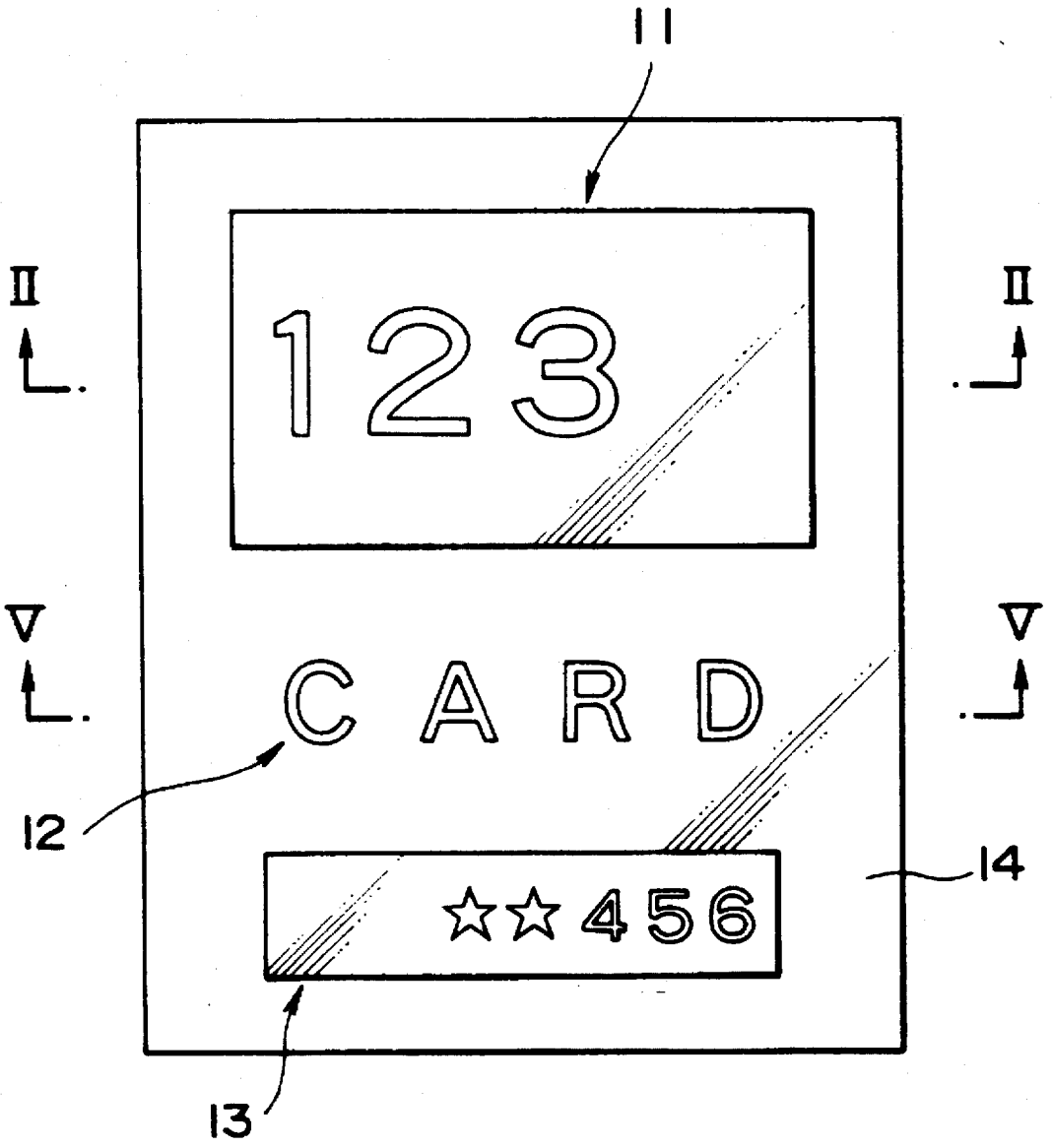
FIG. 1 is a plan view schematically showing one embodiment of a reversible thermosensitive recording medium according to the present invention.
Figure 5:
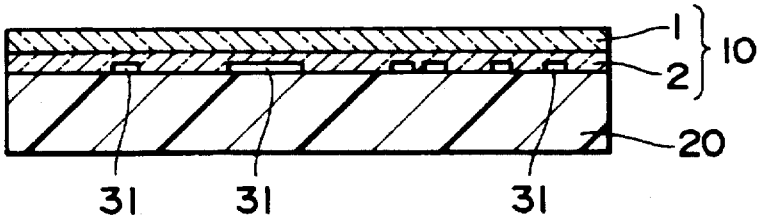
FIG. 5 is a cross-sectional view taken along the line V—V in FIG. 1 and showing a fixed pattern section.

In addition to the main image display section 11, the embodiment shown in FIG. 1 is provided with a pattern 12 and another image display section 13. Rather than by printing with an ink, the pattern 12 is formed by forming void spaces 31 between the transparent recording film 10 and the support 20 according to the desired pattern, as seen from FIG. 5. In the additional image display section 13, the transparent recording film 10 is directly bonded to the support 20 without forming any space therebetween. If desired, the additional display section 13 may be colored or provided with a border. The color or border may be formed by printing on the support 20. Alternatively, the border may be formed by arranging a void space between the support 20 and the recording film 10. Because of the difference in construction, the main image display section 11, the pattern 12, the additional image display section 13 and the background 14 are distinctively visually recognized. In the main and additional display sections 11 and 13, desired images may be recorded by heating these sections imagewise using, for example, a thermal head in a manner known per se. The images in these display sections 11 and 13 can be erased and rewritten as desired.

The following examples will further illustrate the invention. Parts and percentages are by weight.

EXAMPLE 1

A transparent polyester film having a thickness of 50 μm was coated with an adhesive layer (thickness: 0.5 μm) of a polyester resin (BYLON 200 manuafactured by Toyobo Inc.), to which a coating liquid having the following composition was applied:

| | |
|---|---|
| Lignoceric acid | 4 parts |
| Icosanedioic acid | 6 parts |
| Phthalocyanin Blue | 0.1 part |
| Vinyl chloride-vinyl acetate copolymer | 30 parts |
| Tetrahydrofuran | 100 parts |
| Toluene | 50 parts |

The resulting coating was dried at 120° C. to obtain a thermosensitive layer having a thickness of 15 μm. A coating liquid having the following composition:

| | |
|---|---|
| Urethane acrylate UV hardenable resin (UNIDIC C7-157 manufactured by Dai Nippon Ink Inc.) | 10 parts |
| Calcium carbonate | 1 part |
| Isopropanol | 10 parts |

was applied to the thermosensitive layer, dried at 90° C. and irradiated with UV radiation using a 80 W/cm UV lamp, to form a protecting layer having a thickness of about 5 μm. The thus formed transparent recording film had a colorant content of 0.3 mg/100 $cm^2$. The transparent recording film was then bonded with an adhesive to a white polyester film (support) having a thickness of 188 μm such that a space was formed therebetween at an image display section, thereby obtaining a reversible thermosensitive recording card.

EXAMPLE 2

Example 1 was repeated in the same manner as described except that the phthalocyanine blue was replaced by the following black colorant:

| | |
|---|---|
| 3-Diethylamino-7-(o-chloroanilino) fluoran (leuco dye) | 0.04 part |
| 4-Hydroxytridecane anilide (developer) | 0.12 part |

The recording card thus obtained had a colorant content of 0.48 mg/100 $cm^2$.

EXAMPLE 3

Example 1 was repeated in the same manner as described except that the phthalocyanine blue was replaced by the following red colorant:

| | |
|---|---|
| 3-Diethylamino-7,8-benzofluoran (leuco dye) | 0.04 part |
| 1,7-bis (4-hydroxyphenylthio)-3,5-dioxaheptane (developer) | 0.12 part |

The recording card thus obtained had a colorant content of 0.1 mg/100 $cm^2$.

EXAMPLE 4

Example 1 was repeated in the same manner as described except that the phthalocyanine blue was replaced by the following colorant:

KP Blue/Green 860 (oil-soluble dye, manufactured by Nippon Kayaku K. K.) 0.05 part The recording card thus obtained had a colorant content of 0.15 mg/100 $cm^2$.

EXAMPLE 5

Example 1 was repeated in the same manner as described except that the phthalocyanine blue was replaced by the following colorant:

KS Blue 714 (oil-soluble dye, manufactured by Nippon Kayaku K. K.) 0.03 part

The recording card thus obtained had a colorant content of 0.10 mg/100 $cm^2$.

EXAMPLE 6

Example 5 was repeated in the same manner as described except that the KS blue colorant was incorporated into the protecting layer rather than in the thermosensitive layer. The recording card thus obtained had a colorant content of 0.1 mg/100 $cm^2$.

Comparative Example 1

Example 5 was repeated in the same manner as described except that the amount of the KS blue colorant was reduced so that the recording card thus obtained had a colorant content of 0.008 mg/100 $cm^2$.

Comparative Example 2

Example 5 was repeated in the same manner as described except that the amount of the KS blue colorant was increased so that the recording card thus obtained had a colorant content of 2.4 mg/100 $cm^2$.

Comparative Example 3

Example 5 was repeated in the same manner as described except that the KS blue colorant was not used at all.

EXAMPLE 7

Example 1 was repeated in the same manner as described except that the phthalocyanine blue was replaced by the following colorant:

Black G-2 (oil-soluble dye, manufactured by Sumitomo Chemical K. K.) 0.03 part

The recording card thus obtained had a colorant content of 0.10 mg/100 $cm^2$.

EXAMPLE 8

Example 1 was repeated in the same manner as described except that the phthalocyanine blue was replaced by the following colorant:

PS Red EB (oil-soluble dye, manufactured by Mitsui Toatsu Chemical K. K.) 0.03 part The recording card thus obtained had a colorant content of 0.10 mg/100 $cm^2$.

EXAMPLE 9

Example 1 was repeated in the same manner as described except that the phthalocyanine blue was replaced by the following colorant:

Cyan HM-1238 (oil-soluble dye, manufactured by Mitsui Toatsu Chemical K. K.) 0.03 part The recording card thus obtained had a colorant content of 0.10 mg/100 $cm^2$.

EXAMPLE 10

Example 1 was repeated in the same manner as described except that the phthalocyanine blue was replaced by the following colorant:

PS Blue PR (oil-soluble dye, manufactured by Mitsui Toatsu Chemical K. K.) 0.03 part The recording card thus obtained had a colorant content of 0.10 mg/100 $cm^2$.

EXAMPLE 11

Example 9 was repeated in the same manner as described except that the amount of eicosane 2-carboxylic acid was reduced from 6 parts to 5.6 parts and that 0.4 part of Cu salt of stearic acid was substituted for 0.4 parts of eicosane 2-carboxylic acid. The recording card thus obtained had a colorant content of 0.10 mg/100 $cm^2$.

EXAMPLE 12

Example 9 was repeated in the same manner as described except that the amount of eicosane 2-carboxylic acid was reduced from 6 parts to 5.6 parts and that 0.4 part of Co salt of stearic acid was substituted for 0.4 parts of eicosane 2-carboxylic acid. The recording card thus obtained had a colorant content of 0.10 mg/100 $cm^2$.

EXAMPLE 13

Example 10 was repeated in the same manner as described except that a transparent inorganic material-containing layer was interposed between the transparent film layer and the adhesive layer of the transparent recording film. Thus, MgF was deposited by vacuum deposition onto the polyester film (50 μm thick) to a thickness of 900–1,000 Å and ZnS was then deposited by vacuum deposition onto the MgF layer to a thickness 500–600 Å to form the inorganic material-containing layer. Thereafter, the adhesive layer, the thermosensitive layer and the protecting layer were provided on the inorganic material-containing layer.

EXAMPLE 14

Example 1 was repeated in the same manner as described except that the phthalocyanine blue was not incorporated into the thermosensitive layer and that the adhesive layer was substituted by a 3 μm thick intermediate layer of a vinyl chloride/vinyl acetate/phosphate resin (1000P, manufactured by Denka Inc.). The intermediate layer contained a solvent violet dye. The recording card thus obtained had a colorant content of 0.10 mg/100 $cm^2$.

The thus prepared recording cards were measured for their light reflectance, light transmittance and image visibility by the following methods.

Light Reflectance:

Sample recording card is heated at 90° C. in a constant temperature chamber and then cooled to 25° C. so that the image display section assumes the maximum transparent state. The light reflectance (%) is measured with a color analyzer (Type 607, manufactured by Hitachi Ltd.) for a scanned wavelength range of 500–800 nm at an angle of incident of 90°. The sample is heated at 120° C. in a constant temperature chamber and then cooled to 25° C. so that the image display section assumes the maximum opaque state. The light reflectance is then measured in the same manner as above. The light reflectance $R_x$ and $R_y$ of the sample in the maximum transparent state and in the maximum opaque state, respectively, at a wavelength of $\lambda_{max}$ of the colorant are read out and given in Table 1 below.

Light Transmittance:

Sample transparent recording film which has not yet been bonded to a support is heated at 90° C. in a constant temperature chamber and then cooled to 25° C. so that the film assumes the maximum transparent state. The light transmittance (%) is measured with a spectrophotometer (Type 320, manufactured by Hitachi Ltd.) for a scanned wavelength range of 500–800 nm. The light transmittance $T_x$ of the sample in the maximum transparent state at a wavelength of $\lambda_{max}$ of the colorant is read out and given in Table 1 below.

Image Visibility:

Sample recording card in the maximum transparent state is printed imagewise with a thermal head (TCT204, manufactured by Toyo Electronics Inc.). The image is evaluated as being good or not good by the native eyes of a panel of 50 persons. The visibility is rated according to the numbers of persons who regard the sample as being good as follows:

A: more than 40 persons

B: 31–40 persons

C: 21–30 persons

D: 11–20 persons

E: 0–10 persons

The results are shown in Table 1.

TABLE 1

| Example | Reflectance (%) | | | Transmittance | Image |
|---|---|---|---|---|---|
| No. | $R_x$ | $R_y$ | $R_x - R_y$ | $T_x$ (%) | Visibility |
| 1 | 72 | 65 | 7 | 80 | B |
| 2 | 51 | 42 | 9 | 56 | A |
| 3 | 40 | 25 | 15 | 44 | A |
| 4 | 15 | 10 | 5 | 20 | B |
| 5 | 42 | 26 | 16 | 46 | A |
| 6 | 42 | 32 | 10 | 46 | A |
| Comp. 1 | 78 | 76 | 2 | 86 | E |
| Comp. 2 | 4 | 1 | 3 | 5 | D |
| Comp. 3 | 79 | 78 | 1 | 86 | E |
| 7 | 56 | 38 | 16 | 60 | A |
| 8 | 39 | 24 | 15 | 42 | A |
| 9 | 42 | 28 | 14 | 46 | A |
| 10 | 42 | 27 | 15 | 46 | A |
| 11 | 43 | 27 | 16 | 47 | A |
| 12 | 43 | 26 | 17 | 47 | A |
| 13 | 40 | 21 | 19 | 43 | A |
| 14 | 56 | 42 | 14 | 60 | A |

EXAMPLE 15

Example 1 was repeated in the same manner as described that, as shown in FIG. 1, the letters "CARD" and additional image display section were formed. The letters were formed by forming void spaces between the transparent recording film and the support. In the additional image display section, the transparent recording film was directly bonded to the support without forming any space therebetween. The two display sections were then printed with the thermal head. It was found that the images in the two display sections had different color tone from each other. The color tone of the letters "CARD" also differed from those of the images in the display sections.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A reversible thermosensitive recording medium, comprising an opaque support and a transparent recording film provided over a surface of said opaque support and including at least one transparent layer, one of said at least one transparent layer being a thermosensitive layer capable of reversibly assuming a maximum transparent state and a maximum opaque state depending upon the thermal hysteresis thereof, wherein said transparent recording film has an image display section in which a void space is provided between said transparent recording film and said opaque support, wherein one of said at least one transparent layer in said display section contains a colorant having a first color and a maximum absorption wavelength providing a maximum absorbance, wherein said opaque support in the area corresponding to said display section has a second color discriminative from said first color, wherein the reflectance, in terms of %, of said display section for light with said maximum absorption wavelength is $R_x$ when said thermosensitive layer assumes said maximum transparent state but is $R_y$ when said thermosensitive layer assumes said maximum opaque state, said reflectance $R_x$ being greater by at least 5% than said reflectance $R_y$, and wherein the transmittance of said display section of said transparent recording film for light with said maximum absorption wavelength is 20 to 80%, when said thermosensitive layer assumes said maximum transparent state, and wherein said thermosensitive layer comprises a matrix resin and an organic low molecular weight material dispersed in said matrix resin.

2. The recording medium as claimed in claim 1, wherein said transparent recording film is composed of a surface protecting layer, a transparent film layer adjacent to said opaque support and said thermosensitive layer disposed between said protecting layer and said transparent film layer and wherein said thermosensitive layer contains said colorant.

3. The recording medium as claimed in claim 1, wherein said transparent recording film is composed of a surface protecting layer, a transparent film adjacent to said opaque support, and said thermosensitive layer disposed between said colored layer and said transparent film and wherein said surface protecting layer contains said colorant.

4. The recording medium as claimed in claim 1, wherein said transparent recording film is composed of a surface protecting layer, a transparent film layer adjacent to said opaque support and said thermosensitive layer disposed between said protecting layer and said transparent film layer and wherein said transparent film layer contains said colorant.

5. The recording medium as claimed in claim 1, wherein said transparent recording film is composed of a surface protecting layer, a transparent film layer adjacent to said opaque support, said thermosensitive layer disposed between said protecting layer and said transparent film layer and a colored layer disposed on one of the both sides of said transparent film and containing said colorant.

6. The recording medium as claimed in claim 1, wherein said thermosensitive layer additionally contains at least one metal salt of an aliphatic carboxylic acid, said metal being Cu, Cr, Mn, Ni or Co.

7. The recording medium as claimed in claim 1, wherein said colorant is an oil soluble dye in an amount of 0.01–1.0 mg per 100 $cm^2$ of said image display section.

8. The recording medium as claimed in claim 1, wherein said transparent recording film has at least one transparent, inorganic material-containing layer each having an index of refraction different from that of said theremosensitive layer.

9. The recording medium as claimed in claim 8, wherein said opaque support has a white mirror surface.

10. The recording medium as claimed in claim 1, wherein said transparent recording film has a patterned section in which said transparent recording film is provided over a surface of said support with a patterned space being defined therebetween.

11. The recording medium as claimed in claim 1, wherein said transparent recording film has an image display portion in which said transparent recording film is directly provided over a surface of said support without a space being defined therebetween.

12. The recording medium as claimed in claim 11, wherein said opaque support in said image display portion has a color different from said second color.

13. The recording medium as claimed in claim 11, wherein said opaque support in said image display portion is provided with a color pattern different from that in said image display section.

* * * * *

UNITED STATES PATENT AND TRADEMARK OFFICE

CERTIFICATE OF CORRECTION

PATENT NO. : 5,700,746

DATED : December 23, 1997

INVENTOR(S) : Atsushi KUTAMI et al.

It is certified that error appears in the above-indentified patent and that said Letters Patent is hereby corrected as shown below:

On the title page, Item[30], the first Foreign Application Number should read:

-- Mar. 6, 1995 [JP] Japan.....7-072272 --

Signed and Sealed this

Tenth Day of March, 1998

*Attest:*

BRUCE LEHMAN

*Attesting Officer*

*Commissioner of Patents and Trademarks*